US007097322B2

(12) United States Patent
Shuniak

(10) Patent No.: US 7,097,322 B2
(45) Date of Patent: Aug. 29, 2006

(54) ILLUMINATION DEVICE HAVING DETACHABLE LIGHTING UNITS

(76) Inventor: Lawrence Shuniak, 10280 SW. 25th St., Webster, FL (US) 33597

( * ) Notice: Subject to any disclaimer, the term of this patent is extended or adjusted under 35 U.S.C. 154(b) by 189 days.

(21) Appl. No.: 10/659,665

(22) Filed: Sep. 10, 2003

(65) Prior Publication Data

US 2005/0052874 A1 Mar. 10, 2005

(51) Int. Cl.
*F21L 4/04* (2006.01)
*F21L 2/00* (2006.01)

(52) U.S. Cl. ..... 362/199; 362/208; 362/227; 362/372

(58) Field of Classification Search ..... 362/250, 362/374, 3, 11, 109, 116, 157, 190, 191, 227, 362/249, 252, 362, 368, 370, 372, 396, 184, 362/197, 199, 208
See application file for complete search history.

(56) References Cited

U.S. PATENT DOCUMENTS 1,521,610 A * 1/1925 Finesilver ..... 362/250
1,875,956 A * 9/1932 Thiel ..... 362/184
2,602,880 A * 7/1952 Engelhardt et al. ..... 362/282
2,778,931 A * 1/1957 Cruz ..... 362/388
4,262,327 A * 4/1981 Kovacik et al. ..... 362/223
4,302,800 A * 11/1981 Pelletier ..... 362/250
4,428,033 A * 1/1984 McBride ..... 362/183
4,707,766 A * 11/1987 Bertozzi et al. ..... 362/362
4,918,576 A * 4/1990 Farrall et al. ..... 362/250
5,010,454 A * 4/1991 Hopper ..... 362/191
5,567,039 A * 10/1996 Sims ..... 362/191
5,702,176 A * 12/1997 Engle ..... 362/219
5,890,793 A * 4/1999 Stephens ..... 362/250
6,299,327 B1 * 10/2001 Camarota ..... 362/250

* cited by examiner

*Primary Examiner*—Sandra O'Shea
*Assistant Examiner*—Ismael Negron
(74) *Attorney, Agent, or Firm*—Evelyn A. Defillo'; Defillo & Associates, Inc.

(57) ABSTRACT

The present invention relates to a multi-segmented illumination device having at least two segment bodies. Each segment body contains a housing, at least one light source located inside the housing, a power source to power the light source, and at least one power switch connected to each segment body. In addition, each segment body includes at least one attachment point to connect each segmented body to the adjacent segmented body.

11 Claims, 4 Drawing Sheets

ILLUMINATION DEVICE HAVING DETACHABLE LIGHTING UNITS

BACKGROUND OF THE INVENTION

1. Field of the Invention

The present invention relates generally to illumination devices, and more particularly to illumination devices having detachable multiple light sources. Furthermore, the present invention relates to a method for illuminating a dark area by using the illumination device of the present invention.

2. Description of the Related Art

Since the days that man harnessed fire to warm him, cook food over, and more importantly, to light his cave or camp, illumination has been a constant challenge after the sun goes down.

As man progressed from caves to houses and buildings, and eventually to full illumination with the electric light bulb, illumination remains a problem to man, particularly when camping outside, or when he is inside a room having dark or uneven surfaces for light to reflect off.

The major problem with lighting outdoors, or in areas without reflective walls, is the light source is isolated. That is, the light only illuminates directly from the source.

To illuminate an area, the prior art discloses the use of large bonfires, campfires, oil lanterns, gas lanterns, florescent lamps, propane lanterns, and flashlights. All of these forms of light source have one thing in common, they are central sources of light that illuminate in all directions and require a central power source. Power sources include wood, oil, gas, propane, AC electric power, and battery. Light sources include flame, lighted mantels, florescent bulbs, incandescent bulbs and, lately, Light Emitting Diodes (LEDs).

A disadvantage presented by the illumination devices of the prior art is that the light produced by these devices has a limited effective range. The small viewing angle created by the light source projects the light in a fashion such that when used in a flashlight or like device, the majority of the light does not hit the reflective surface of the flashlight's reflector. Thus, they poorly illuminate the desired area. As a consequence, the user is required to place multiple illumination devices around the room to properly illuminate the desired room. The use of multiple illumination devices is relatively expensive.

The present inventor thought of the necessity of having an illumination device that would illuminate the desired area by emitting light into a central area rather than a central light source emitting light outward.

United States Patent Application Publication Number US 2003/0035287 A1, entitled "Double Lamp Utility Light" to Kovacik et al, discloses a lamp having multiple light sources having a double lamp utility light formed into two halves. An electrical outlet was provided on the bottom of the handle. A pair of switches on the handle controlled respective pairs of twin bulbs. The central source of light only illuminates the area that it is immediately placed in. While each set of twin bulbs may be independently illuminated, they cannot be removed and placed independently, nor do they include their own power source.

In addition, the lamp is designed to only provide a light at a single location from multiple sources. Thus, the Kovacick et al. reference does not overcome the disadvantage presented by the prior art.

European Patent Number EP 0 639 874 A3, entitled "Multi-Array Twin Tube Lamps" to Hammer et al, discloses a compact multiple tube lamp with a specific base allowing multiple twin tube lamps to be assembled together in close proximity with each tube lamp having an independent voltage as a power source. The reference does not provide an assembly in which a light source is assembled into a portable multi-segmented light source for use in areas outdoors.

World Patent Number 96/37731 entitled "SearchLight" to Bergkvist et al., discloses a light having a directional light including at least three lamps. Each lamp having individual light sources which are mechanically fixed in relation to the adjacent lamp. The disadvantage to this particular illumination device is that while its light sources are independent light emitters, they can still not be disassembled independently from each other and placed where light is needed.

In summary, the illumination devices of the prior art do not provide an illumination device, which, while being portable, provide light source that is independently "split" away from each other and placed where light is needed.

None of the illumination devices of the prior art has a satisfactory solution for correctly illuminating outdoors areas or areas not having reflective walls.

These and other features addressed by the invention will become apparent from a review of the following discussion

SUMMARY OF THE INVENTION

The invention offers at least one of the following advantages:

provides an illumination device that would illuminate a desired area by emitting light into a central point rather than a central light source emitting light outward;

provides an illumination device having the capabilities of being divided into multiple segments, which will provide a quality lighting condition in multiple environments including outdoors;

provides an illumination device that is easy to manufacture;

provides an illumination device that is capable of having its light emitting segments split for placement anywhere light is required.

The present invention relates to an illumination device that includes multiple light sources that can individually be separated to illuminate a site, object, room, or similar from any direction.

Each segmented body can work independently as any conventional illumination devices such as lantern, lamp, flashlight, etc.

The present invention presents the ability of detaching the segmented bodies in order to place each one of them in the desired position.

The illumination device comprises:

at least two segment bodies, each segment body having:

a housing;

at least one light source located inside the housing, a power source to power the at least one light source;

wherein each segment body includes at least one attachment point to connect each segmented body to the adjacent segmented body.

The invention further includes at least one power switch connected to each segment body, wherein each power switch turns the at least one light source on and off on each segment body.

The multi-segmented illumination device of the present invention can operate in either conventional mode or segmented mode. In the conventional mode, all the segmented bodies are connected together forming a conventional illumination device.

The at least one segmented body further includes at least one hook for hanging each segmented body.

The light source can be chosen from LED, incandescent bulb, a conventional light source, flame, lighted mantels, florescent bulbs, or combinations thereof.

The power source is inclusive of, but not limited to, batteries, wood, oil, gas, propane, and AC electric power.

The multi-segmented illumination device can further include a main power switch means, thus when the segment bodies are assembled together, the illumination device of the present invention can be turned on or off by using the main power switch means.

Each segmented body can further comprise a transparent or translucent globe that houses the light source.

The present invention also contemplates a method for illuminating a dark area comprising:

providing at least one illumination device having:

at least two segment bodies, each segment body having:

a housing;

at least one light source located inside the housing, a power source to power the light source, at least one power switch connected to each segment body, wherein each power switch turns the light source on and off on each segment body;

wherein each segment body is connected to the adjacent segment body by an attachment point;

disconnecting each segment body from the adjacent segment body; and placing each segment body around the area to be illuminated.

DESCRIPTION OF THE DRAWINGS

For a fuller understanding of the nature and advantages of the invention, reference should be made by the following detailed description taken in with the accompanying drawing in which.

DESCRIPTION OF THE INVENTION

The present invention represents a revolutionary concept for camping and outdoor activities after daylight.

The invention provides the ability of quality lighting outdoors while maintaining portability, flexibility, and economical costs of use.

The invention relates to an illumination device that includes multiple light sources, which can individually emit light in any direction.

FIGS. 1–4 show an illumination device having batteries as a power source, but the present invention is not limited to batteries as power source. Other power sources that are not shown by the drawings are wood, oil, gas, propane, and AC electric power, and a combination thereof.

Figure 1:
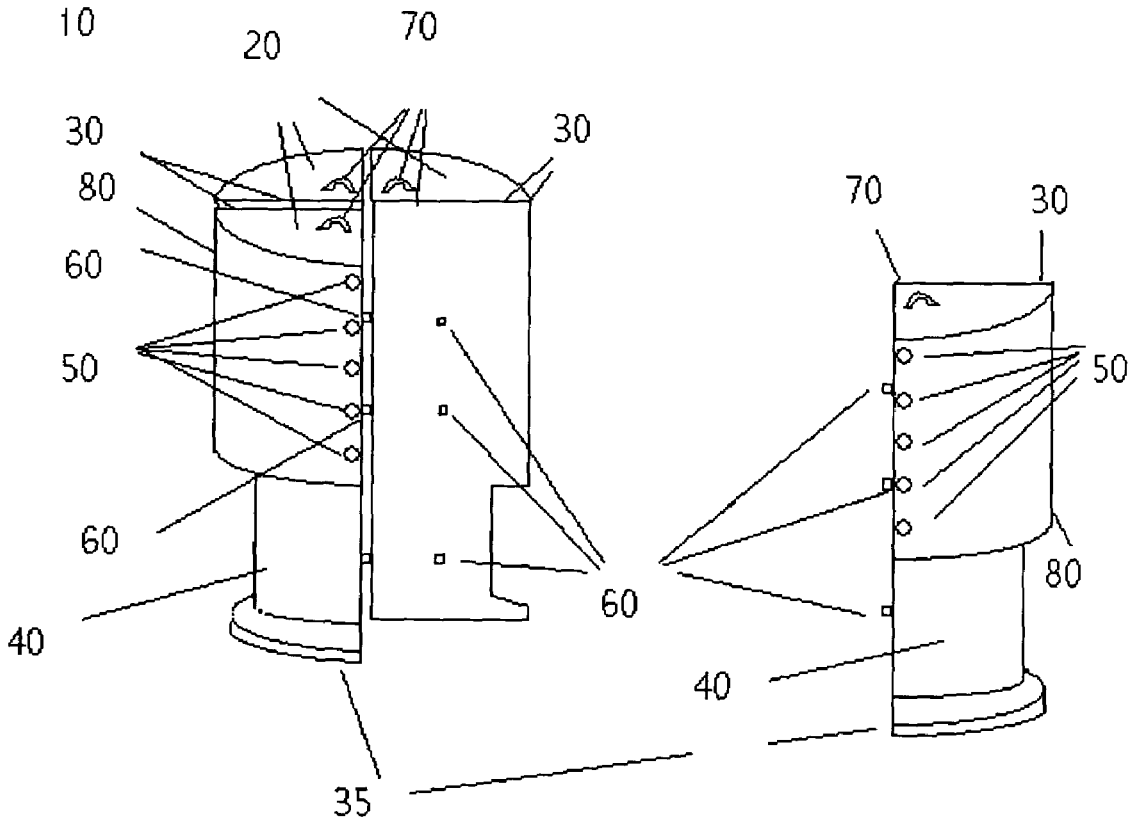
FIG. 1 shows a perspective view of the multi-segmented illumination device according to the present invention showing one section detached.

FIG. 1 shows a perspective view of the multi-segmented illumination according to the present invention showing one section detached. The illumination device 10 comprising:

at least two segment bodies 20, each segment body having:

a housing 30 having a base 35;

at least a power source 40, and at least one light source 50 located inside each housing 30, wherein segment body 20 includes at least one attachment point 60 to connect each segmented body to the adjacent segmented body.

The invention optionally includes at least one power switch (not illustrated) connected each segment body, wherein each power switch turns the light source on and off on each segment body;

The at least one segmented body 20 can further include at least one hook 70 for hanging the segmented body. The at least one segmented body further comprises a transparent or translucent globe 80 that houses the light source.

The light source can be chosen from LED, incandescent bulb, a conventional light source, flame, lighted mantels, florescent bulbs, incandescent bulbs or combinations thereof.

The power source is inclusive of, but not limited to, batteries, wood, oil, gas, propane, AC electric power, or combination thereof.

The term "light source" even in the singular is not necessarily limited to a single light bulb, LED or other lamp. Rather, each electric light source may include more than one light bulb, LED or other lamp. With such possible arrangements in mind, the invention contemplates the use of employing a first power source for the first one of the two light sources and a second power source for the second of the two light sources.

When the power source 40 is a battery, they may be housed in a compartment 90 and covered with a lid at the bottom side of each segmented body 20. The battery supply may include rechargeable batteries.

Each of the light sources are controlled by the corresponding individual switches incorporated with the corresponding segmented body. In addition, each power source is connected to a commercial power source through a main switch (not shown). The main switch is capable of switching the entire device between on and off states upon movement of the main switch. Thus, when the segment bodies are assembled together, the illumination device of the present invention can be turned on or off by using the main power switch.

A conventional fuel-burning illumination device typically comprises a refillable fuel storage tank, fuel delivery means, and a burner attached to the fuel delivery means. The burner typically comprises a mantle which when ignited with a fuel/air mixture provided by the fuel delivery means emits a bright light. The burner is usually covered by a transparent glass cover. Fuel typically used with such illumination devices includes liquid propane, butane, white gas and gasoline.

FIG. 1 shows an illumination device having four segmented bodies. Any person skilled in the art will understand that the number of segmented bodies depends on the geometrical form of the illumination device.

Figure 2:
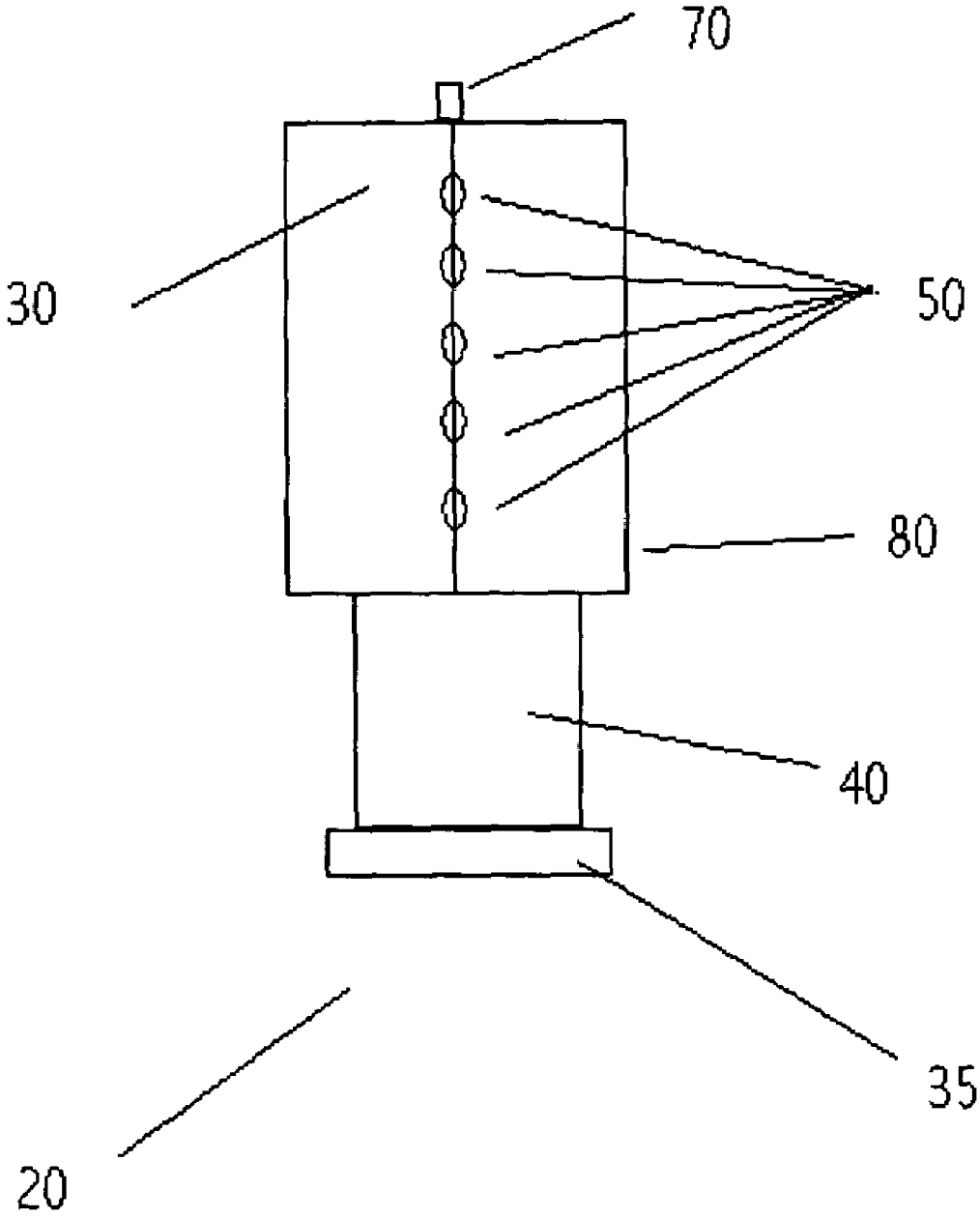
FIG. 2 shows a front view of one segment of the multi-segmented illumination device according to the present invention using LED light sources.

FIG. 2 shows a front view of one segment of the multi-segmented illumination device according to the present invention using LED light sources.

Figure 3:
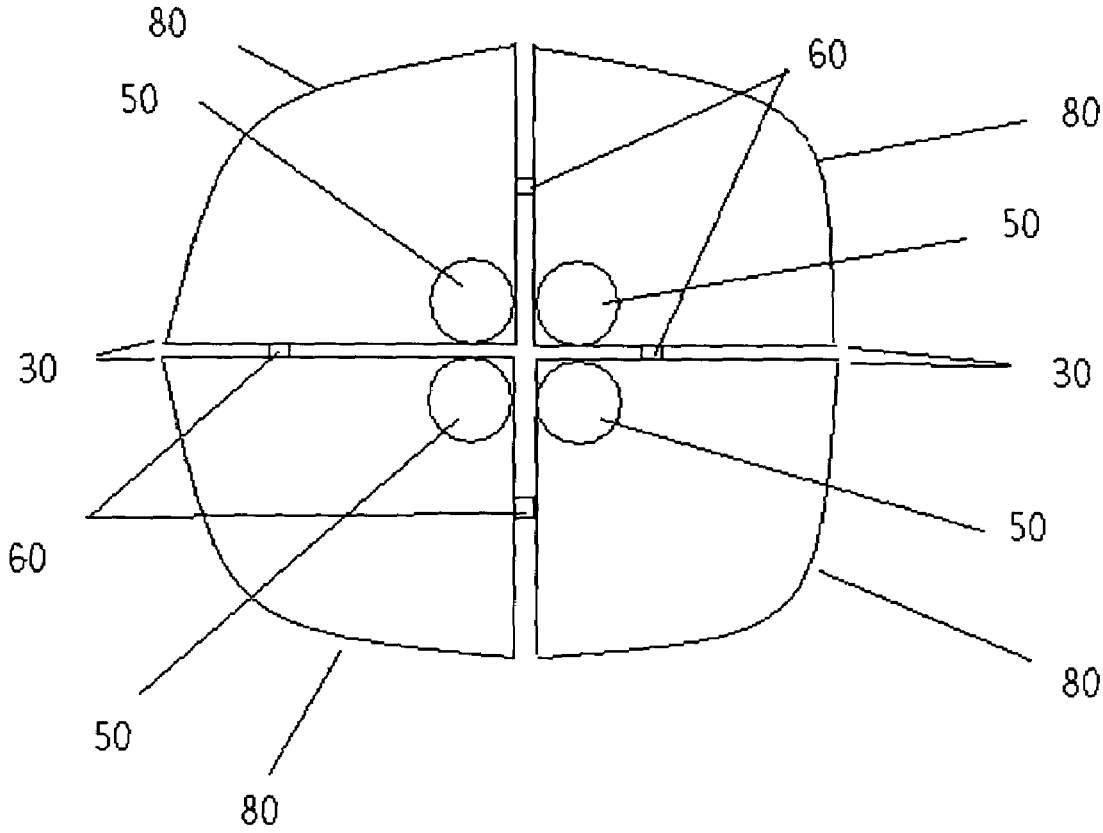
FIG. 3 is a top view of the multi-segmented illumination device according to FIG. 2.

FIG. 3 illustrated a top view of the illumination device according to the present invention showing all segment bodies and their relationship to each other when all the segments are attached to each other. The Figure shows the use LEDs at the inside corners of each segment body on the reflective housing side.

Figure 4:
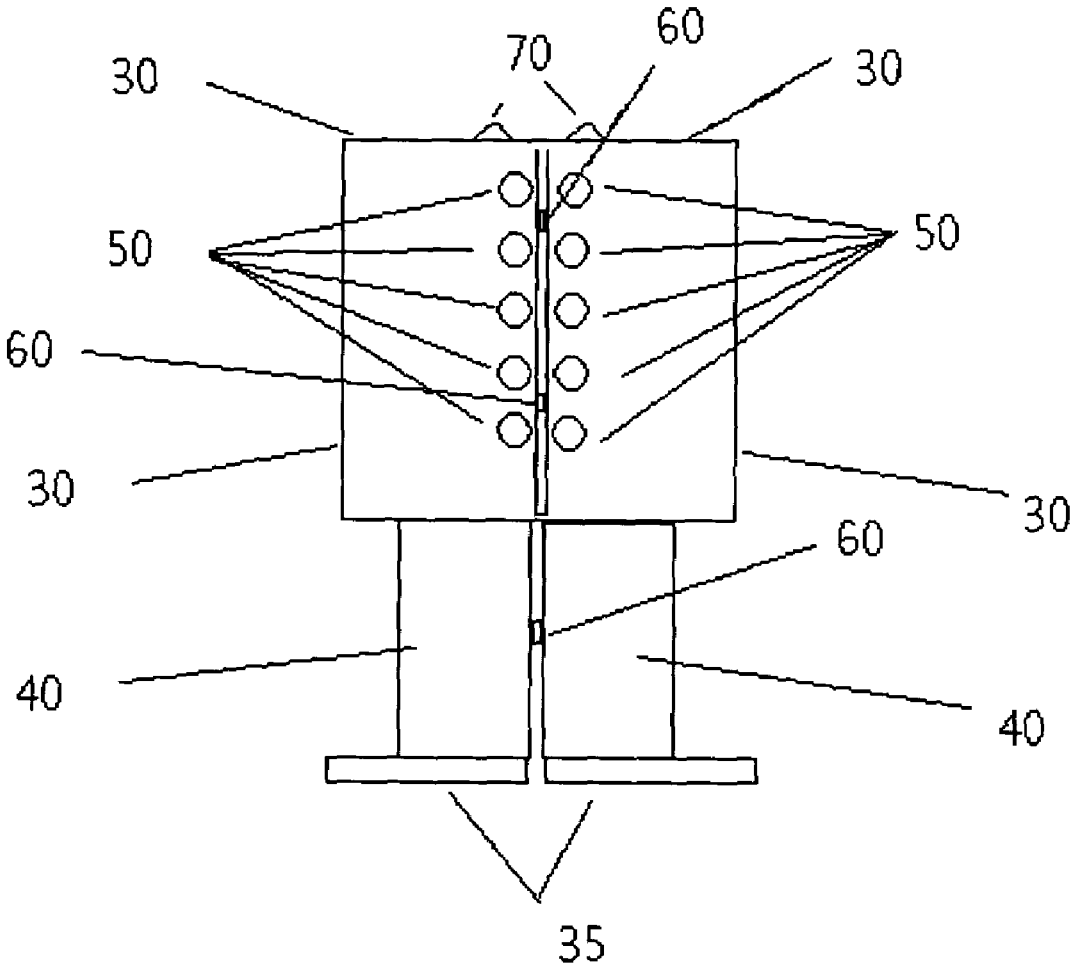
FIG. 4 is a side view of the multi-segmented illumination device according to FIG. 2.

FIG. 4 is a side view of the multi-segmented illumination device according to the present invention. The figure shows the area between two segments.

The illumination device of the present invention reduces the number of devices that must be purchased and carried by consumers to properly illuminate the desired area. This results in a more cost-effective and efficient approach in fulfilling the diverse lighting needs of consumers.

The present invention also contemplates a method for illuminating a dark area comprising:

providing at least one illumination device having:

at least two segment bodies, each segment body having:

a housing;

at least one light source located inside the housing, a power source to power the light source, at least one power switch connected to each segment body, wherein each power switch turns the light source on and off on each segment body;

wherein each segment body is connected to the adjacent segment body by at least one attachment point;

disconnecting each segment body from the adjacent segment body; and placing each segment body around the area to be illuminated.

The design of the detachable multi-segmented illumination device according to the present invention, in which each segment has its own light emitter and independent power source, allows the user to independently place each segment anywhere a direct source is needed to best illuminate an area.

When used outside, the design of the present invention allows to shine light into a site from all directions, creating the ambiance of being in an inside room while still being in the outdoors, thus card playing, writing, or reading occurs naturally and not huddled over a lamp.

A person skilled in the art will note that none of the components of the multi-segmented lantern invention are unique in the world. All have been used before in other ways. However, the combination of these elements that are easily detachable, independently powered, and designed to create an indoor lighting quality outdoors, is novel and useful.

What is claimed is:

1. An illumination device comprising:

a substantially uniformly shaped housing including at least two detachable segment bodies, each segment body having a shape substantially identical to the other segment body, further having:

at least one light source located inside the segment body, a power source to power the at least one light source;

at least one interconnection attachment point for interconnecting with the attachment point of an adjacent segment body;

at least two of the plurality of segment bodies being selectively attached together by the interconnection attachment points, each of the segment bodies being shaped to complement one another to form the housing when interconnected.

2. The illumination device according to claim 1, further including at least one power switch connected to each segment body, wherein each power switch turns the at least one light source on and off on each segment body.

3. The illumination device according to claim 1, wherein each segment body further includes a hook for hanging each segment body.

4. The illumination device according to claim 1, wherein the power source is chosen from batteries, wood, oil, gas, propane, AC electric power, or combination thereof.

5. The illumination device according to claim 1, wherein the light source is chosen from LED, incandescent bulb, florescent bulb, or combinations thereof.

6. The illumination device according to claim 1, further including a main power switch, wherein when the segment bodies are assembled together, the illumination device is turned on or off by using the main power switch.

7. The illumination device according to claim 1, wherein each segment body further comprises a transparent or translucent globe that houses the light source.

8. A method for illuminating a dark area comprising:

a) providing an illumination device comprising:

a substantially uniformly shaped housing including at least two detachable segment bodies, each segment body having a shape substantially identical to the other segment body, further having:

at least one light source located inside the segment body, a power source to power the at least one light source;

at least one interconnection attachment point for interconnecting with the attachment point of an adjacent segment body;

at least two of the plurality of segment bodies being selectively attached together by the interconnection attachment points, each of the segment bodies being shaped to complement one another to form the housing when interconnected;

b) disconnecting each segment body from the adjacent segment body; and c) placing each segment body around the dark area.

9. The method according to claim 8, further comprising connecting at least one power switch to each segment body, wherein each power switch turns at least one light source on and off on each segment body.

10. The method according to claim 8, wherein the power source is chosen from batteries, wood, oil, gas, propane, AC electric power, or combination thereof.

11. The method according to claim 8, wherein the light source is chosen from LED, incandescent bulb, florescent bulb, or combinations thereof.

* * * * *